US005592994A

United States Patent [19]

Laporte et al.

[11] Patent Number: 5,592,994

[45] Date of Patent: Jan. 14, 1997

[54] PROPULSION SEAL FOR WIRE LINE CORE DRILLING APPARATUS

[75] Inventors: Irvin J. Laporte; Amos J. Watkins, both of North Bay, Canada

[73] Assignee: JKS Boyles International Inc., North Bay, Canada

[21] Appl. No.: 529,747

[22] Filed: Sep. 18, 1995

[30] Foreign Application Priority Data

Dec. 15, 1994 [CA] Canada ..... 2138201

[51] Int. Cl.[6] ..... E21B 25/00

[52] U.S. Cl. ..... 175/247; 175/250

[58] Field of Search ..... 175/246, 244, 175/236, 247, 258, 20, 250, 243

[56] References Cited

U.S. PATENT DOCUMENTS

| | | | |
|---|---|---|---|
| 3,777,826 | 12/1973 | Wolda | 175/46 |
| 4,664,204 | 5/1987 | Nenkov et al. | 175/44 |
| 4,800,969 | 1/1989 | Thompson | 175/246 |
| 5,020,612 | 6/1991 | Williams | 175/234 |
| 5,095,988 | 3/1992 | Bode | 166/291 |
| 5,139,274 | 8/1992 | Oseman . | |
| 5,169,160 | 12/1992 | Gaskill et al. . | |
| 5,267,620 | 12/1993 | Lee | 175/230 |
| 5,339,915 | 8/1994 | Laporte et al. | 175/244 |

FOREIGN PATENT DOCUMENTS

| | | |
|---|---|---|
| 2087303 | of 0000 | Canada . |
| 2093226 | of 0000 | Canada . |
| 1013386 | 7/1977 | Canada . |
| 1098143 | 3/1981 | Canada . |
| PTC90/07664 | of 0000 | WIPO . |

*Primary Examiner*—Frank Tsay
*Attorney, Agent, or Firm*—John W. Ross

[57] ABSTRACT

There is provided a wire line core drilling apparatus including an elongated assembly which is hydraulically propelled along the interior of a drill string to a desired location adjacent the bit end of the drill string under the influence of a moving pressurized liquid within the drill string, characterized in that said elongated assembly is provided with an annular cup seal having a flexible annular lip thereon which expands radially outwardly under the influence of liquid pressure thereon to substantially prevent by-pass of the pressurized liquid between the elongated assembly and the interior wall of the drill string and which annular lip is capable of expanding and contracting as said assembly moves along the drill string interior to accommodate reasonable fluctuations in drill string interior diameter which may be encountered.

6 Claims, 2 Drawing Sheets

PROPULSION SEAL FOR WIRE LINE CORE DRILLING APPARATUS

BACKGROUND OF THE INVENTION

This invention relates to the art of drilling and in particular it relates to wire line core drilling apparatus.

In the course of wire-line drilling, a core barrel inner tube assembly is dropped or pumped along the bore of a drill string to a position just above or behind the drill bit. The drill string is provided with an annular landing shoulder therein. The inner tube assembly is also provided with a landing shoulder which is adapted to co-operate with and seat on the landing shoulder of the drill string. The inner tube assembly is provided with spring loaded latches which automatically move outwardly and engage in an annular recess, termed the latch seat, which is provided in the lower section of the drill string (otherwise known as the outer tube) thereby to anchor the inner tube assembly against axial movement in the drill string. A drilling liquid, typically water, is pumped along the drill string thereby to propel the inner tube assembly along to the landing position which is of course correctly positioned relative to the drill bit.

The primary objective of a core drilling operation is to obtain a core of drilled material for purposes of geological analysis. The distal end of the drill string is accordingly provided with an annular drill bit of any desired well known variety, the bit having diamonds or board embedded therein to enable the bit to cut through the hardest formations likely to be encountered. As the drilling proceeds, the rotating bit cuts through the formations and a core of the formation being drilled moves into and is captured by the core receiving barrel of the inner tube assembly. When the core barrel is filled, the drilling operator on the surface passes an overshot assembly along the drill string. The overshot assembly is arranged to engage with the upper end of the inner tube assembly and a wire line attached to the overshot is then tensioned in the course of which the spring loaded latches release thus allowing the inner tube assembly to be pulled to the surface. The core of material, which has broken off from the formation, is captured within the inner tube assembly in well known fashion and when the inner tube assembly reaches the surface the core is removed and taken away for analysis. Following this, the inner tube assembly is then passed along the drill string in preparation for the taking of a further sample. The flow of drilling liquid is typically provided by a flush pump which is capable of producing the flow rates and pressures required during the course of a drilling operation.

During the course of a normal core drilling operation, the above-noted pump forces the drilling liquid along the drill string, through and along the above-noted inner tube assembly, and to the bit where the liquid cools the bit and flushes away the cuttings therefrom, the fluid velocity being sufficient to move these cuttings along the exterior of the drill string and along the drill hole to the surface.

Surface drilling differs from underground drilling primarily as a result of the orientation or inclination of the holes to be drilled. The average surface bore hole may have an orientation which is anything from a truly vertical position to a position making approximately a 45° angle with the surface. An underground drill hole may be oriented anywhere between a horizontal position and a position which is vertical or straight-up.

In the case of surface drilling, gravity is used to advantage as the core barrel and overshot assembly are being moved to their respective positions and the use of drilling liquid to assist in moving these items is to complement the force of gravity and to speed up the process. However, in underground drilling, the propulsion of the tools hydraulically in an efficient manner is of paramount importance as gravity is working against these tools as they are being moved toward the bit-end of the drill string.

In order that the hydraulic propulsion process may be as efficient as possible, prior art core drilling apparatus has made provision for a type of piston packing on both the core barrel and overshot assemblies made either from rubber or a suitable polymer material. The piston packing typically takes the form of one or more relatively thick washers. With these packings in place on the wire line assemblies, the same can be squeezed axially to match approximately the inside diameter of the drill string by way of an adjusting nut to apply the correct amount of axial pressure. If the piston packing is too loose, a substantial portion of the propelling fluid will bypass the core barrel and/or overshot assembly and the process of hydraulically propelling the latter along the drill string will be slow and inefficient. In theory, these piston packings are supposed to work but in practice the outside diameter of the resilient packing soon becomes reduced as a result of wear and if the piston packings are not constantly adjusted by means of the adjustment nuts noted above, the hydraulic pumping operation soon becomes slow and inefficient.

SUMMARY OF THE INVENTION

It is a primary object of the present invention to provide improvements in core drilling apparatus of the type discussed above, which improvements enable the apparatus to be hydraulically propelled along the drill string at a faster and more consistent rate than hitherto.

Accordingly one aspect of the invention provides a wire line core drilling apparatus including an elongated assembly which is hydraulically propelled along the interior of a drill string to a desired location adjacent the bit end of the drill string under the influence of a moving pressurized liquid within the drill string, characterized in that said elongated assembly is provided with an annular cup seal having a flexible annular lip thereon which expands radially outwardly under the influence of liquid pressure thereon to substantially prevent by-pass of the pressurized liquid between the elongated assembly and the interior wall of the drill string and which annular lip is capable of expanding and contracting as said assembly moves along the drill string interior to accommodate reasonable fluctuations in drill string interior diameter which may be encountered.

In a further aspect of the invention said elongated assembly comprises a core barrel inner tube assembly.

In a further aspect of the invention said elongated assembly comprises an overshot assembly adapted to latch on to the core barrel inner tube assembly so that the overshot assembly together with the inner tube assembly may be retracted from the bit end of a drill string.

In a typical preferred embodiment of the invention both the overshot and inner tube assemblies have fluid flow channels therethrough and valve means for opening said channels when retraction occurs and for closing said channels when said assemblies are being propelled by said liquid.

In a preferred form of the invention said annular cup seal is of a polyurethane elastomer. Preferably, the cup seal has a hardness of about A90 Durometer.

Further features of the invention will become readily apparent from the following description of a preferred embodiment of the invention read in conjunction with the appended drawings.

BRIEF DESCRIPTION OF THE VIEWS OF DRAWINGS

DETAILED DESCRIPTION OF THE PREFERRED EMBODIMENT

Figure 1:
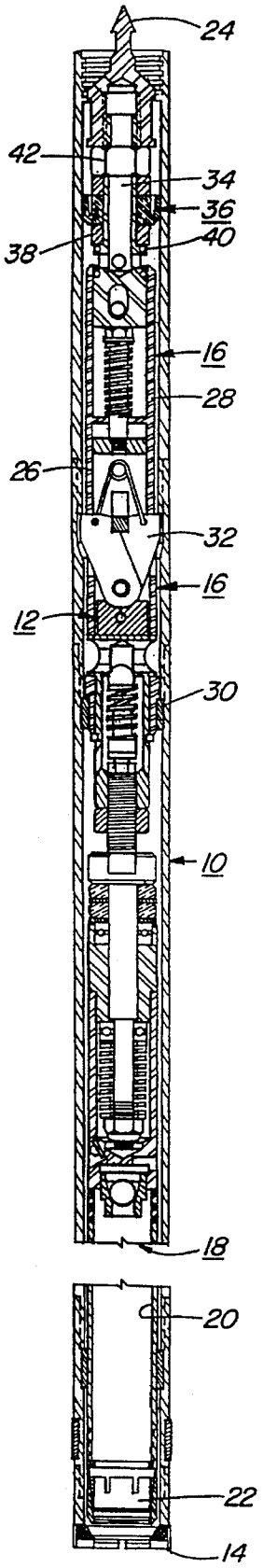
FIG. 1 is a longitudinal section view of a core barrel inner tube assembly incorporating principles of the present invention.

With reference to FIG. 1 there is shown a hollow drill string 10 having an annular drill bit 14 at the lower end thereof, e.g. a so-called diamond core bit. A core barrel inner tube assembly 12 is located within the lower end of the drill string, this assembly including a head end assembly 16 and a lower tube assembly 18.

The core barrel inner tube assembly 12 need not be described in detail as it is primarily of conventional construction and may be of the type which is commercially available from JKS Boyles International Inc. and is known as the BO-U Wire Line Core Barrel. For a detailed description of same reference may be had to applicants' U.S. Pat. No. 5,339,915 issued Aug. 23, 1994 the disclosure of which is incorporated herein by reference thereto.

The lower tube assembly 18 includes a core receiving inner tube 20 which is provided at the lower end with a core lifter ring 22 all of which are well known in the art.

The main components of head end assembly 16 starting at the upper end are the well known lifting spear 24 which is located above the upper end of a latch body 26, the upper end of which is disposed in a latch case 28. The latch body defines an annular landing shoulder which rests on a hardened landing ring 30 secured in a recess in the drill string 10. The latch case has diametrically opposed slots therein through which opposed spring-loaded latches 32 project. As is well known the main functions of the latch are to transmit rotary motion of the drill string to the head end assembly 16 and to anchor the assembly against axial motion in the drill string. In order to retract latches 32 into the latch case, the latter is movable axially relative to the latch body 26 in response to lifting forces on lifting spear 24 which is connected to the upper end of the latch case via an elongated hollow spindle 34. When the latches 32 have been retracted, the entire core barrel inner tube assembly, together with a drill core which has been received within the core receiving inner tube 20, may be lifted upwardly through the drill string by way of an overshot assembly (FIG. 2) to which a wire line is connected.

Once the inner tube assembly has been lifted clear of the landing ring 30, drilling fluid contained within the drill string can pass through a series of ports and passages, including ports in the spear head 24, through the hollow spindle 34 and thence around the remaining major components of the assembly so that the drill string remains essentially filled with drilling liquid as the core barrel inner tube assembly is drawn through the drill string, all in a manner well known in the art.

In accordance with the invention, a propulsion seal 36 is mounted on the spindle 34 generally intermediate the spear head 24 and the latch assembly as briefly described above. The propulsion seal 36 is retained in its axial position on the spindle 34 by way of opposed annular spacer rings 38, the lowermost one bearing against an annular shoulder which carries O-ring 40. A lock nut 42 positioned immediately below the spear head 24 retains this assembly securely together.

Figure 3:
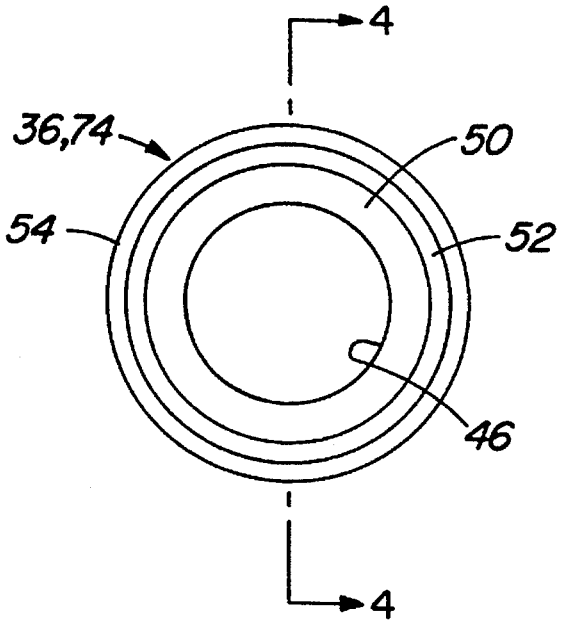
FIG. 3 is a plan view of the propulsion seal per se.
Figure 4:
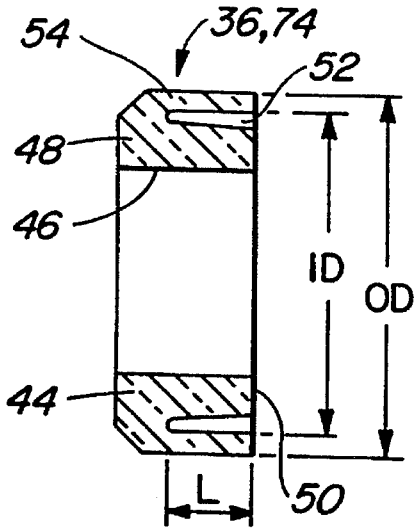
FIG. 4 is a section view of the propulsion seal taken along line 4—4 of FIG. 3.

The propulsion seal 36 is shown in greater detail in FIGS. 3 and 4. It essentially comprises an annular or ring-like body 44 having a central aperture 46 therethrough sized to accommodate the above-noted spindle. The opposing annular faces 48, 50 of the seal are co-planar with each other. The annular face 50 is provided with an annular groove 52 of a somewhat truncated shallow-angle V-shape cross-sectional configuration. This annular groove is located sufficiently close to the outer perimeter of the propulsion seal as to define a relatively thin walled lip 54 of sufficient flexibility that, under normal fluid propulsion pressures existing within the drill string as the inner tube assembly is being propelled therealong, such fluid pressures are sufficient as to cause this lip 54 to flex outwardly into close contacting relation with the inner wall of the drill string and to follow irregularities in the inside diameter of same thereby to substantially prevent by-pass of the pressurized fluid.

A preferred material for the propulsion seal 36 is a polyurethane elastomer, such material typically having a hardness of A90-95 Durometer. This material is resilient while at the same time being very tough and long-wearing, i.e. resistant to abrasion and can be used many times over without requiring replacement.

The following table gives some of the major dimensions of a typical propulsion seal and illustrates, for example, the thickness of the lip 54 in the radial direction as well as its length in the axial direction.

TABLE

| | |
|---|---|
| Lip outside diameter (OD) (unstressed) | 45.72 (mm) |
| Lip inside diameter (ID) (unstressed) | 41.27 (mm) |
| Lip axial length (L) | 9.52 (mm) |
| Hardness | A90 Durometer |

Figure 2:
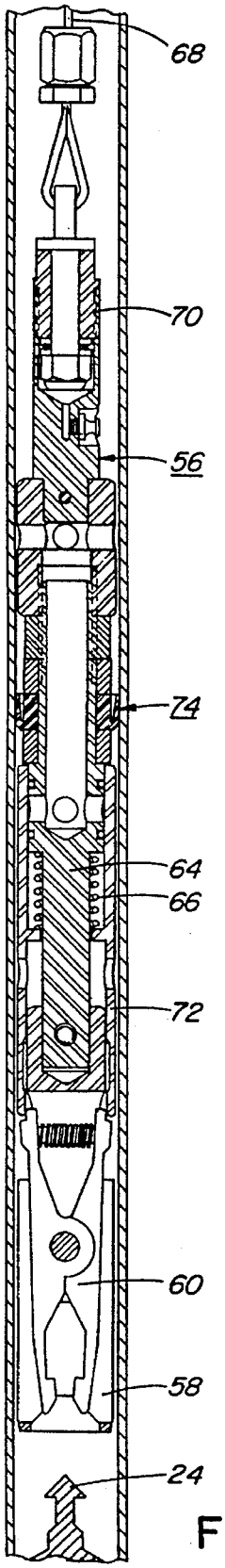
FIG. 2 is a longitudinal section view of an overshot assembly incorporating the principles of the present invention.

Turning now to FIG. 2 there is shown a typical overshot assembly 56 incorporating a propulsion seal 74 as described previously with reference to FIGS. 3 and 4. The overshot assembly need not be described in detail as it is, apart from the propulsion seal, essentially of a conventional construction. The overshot assembly may be of the type manufactured by JKS Boyles International Inc. and known as the BO-U Overshot Assembly and the same is shown here as being outfitted with a JKS Boyles International Inc. BO-U Swivel Assembly.

The overshot assembly generally designated 56 is provided at its lower end with a conventional overshot head 58 and a pair of opposed spring-loaded lifting dogs 60 adapted to releasably engage the spear point 24 of the core barrel inner tube assembly as described previously. The overshot is provided with a ported valve sleeve 62 which is movable in the axial direction relative to the valve stem 64 under the influence of a valve spring 66. When the overshot is pulled along the drill string via the wire line 68 it transmits forces through the swivel assembly 70 to the shaft of the overshot assembly, and the valve sleeve 62 moves in the axial direction so as to allow drilling fluid within the drill string to move through the various ports and axial passages in a manner shown by the arrows thereby to allow fluid bypass around the propulsion seal 74 thus avoiding the necessity of significantly displacing the drilling fluid located within the drill string. As the overshot is being pulled along via the wire line, the lifting dogs 60 securely grip the spear head 24 in a manner well known in the art thereby moving the inner tube assembly along with the core to the surface.

In the case of underground drilling with which we are primarily concerned here, the overshot assembly 56 is propelled along the drill string by means of a flow of pressurized drilling liquid toward the core barrel inner tube assembly. As described previously, the radially outwardly disposed annular lip 54 of the propulsion seal flexes radially inwardly and outwardly under the influence of the liquid pressure acting thereon to accommodate variations in the inside diameter of the drill string in the course of its passage therealong thus preventing any significant bypass of the pressurized drilling liquid around the overshot assembly. During the course of this movement the valve sleeve 62 is in an axial position blocking flow of the drilling fluid through the ports and axially extending passageways of the overshot assembly.

After the overshot assembly 56 has reached the inner tube assembly and the lifting dogs 60 have engaged the spear point 24, the wire line 68 is tensioned and the overshot assembly and core barrel inner tube assembly are drawn together outwardly along the drill string. As noted previously, in the course of this movement, the fluid passageways through the two assemblies are open so that the drilling fluid can readily bypass the two propulsion seals 36,74 thus avoiding the need to displace any significant quantity of drilling fluid contained within the drill string.

Preferred embodiments of the invention have been described by way of example. Those skilled in the art will realize that various modifications and changes may be made while remaining within the spirit and scope of the invention. Hence the invention is not to be limited to the embodiments as described but, rather, the invention encompasses the full range of equivalencies as defined by the appended claims.

We claim:

1. Wire line core drilling apparatus including an elongated assembly which is hydraulically propelled along the interior of a drill string to a desired location adjacent the bit end of the drill string under the influence of a moving pressurized liquid within the drill string, characterized in that said elongated assembly is provided with an annular cup seal having a flexible annular lip thereon which expands radially outwardly under the influence of liquid pressure thereon to substantially prevent by-pass of the pressurized liquid between the elongated assembly and the interior wall of the drill string and which annular lip is capable of expanding and contracting as said assembly moves along the drill string interior to accommodate reasonable fluctuations in drill string interior diameter which may be encountered.

2. Apparatus according to claim 1 wherein said elongated assembly comprises a core barrel inner tube assembly.

3. Apparatus according to claim 2 wherein said elongated assembly further comprises an overshot assembly adapted to latch on to the core barrel inner tube assembly so that the overshot assembly together with the inner tube assembly may be retracted from the bit end of a drill string.

4. Apparatus according to claim 3 wherein both the overshot and inner tube assemblies have fluid flow channels therethrough and valve means for opening said channels when retraction occurs and for closing said channels when said assemblies are being propelled by said liquid.

5. Apparatus according to claim 1 wherein said annular cup seal is of a polyurethane elastomer.

6. Apparatus according to claim 5 wherein the cup seal has a hardness of about A90-95 Durometer.

* * * * *